US011369137B1

(12) United States Patent
Wahidi

(10) Patent No.: US 11,369,137 B1
(45) Date of Patent: Jun. 28, 2022

(54) SMOKABLE INSERT SYSTEM INCLUDING FLAVOR RELEASING MECHANISMS HELD BY AN INTERNAL PARTITION

(71) Applicant: Jawid Wahidi, Irvine, CA (US)

(72) Inventor: Jawid Wahidi, Irvine, CA (US)

( * ) Notice: Subject to any disclaimer, the term of this patent is extended or adjusted under 35 U.S.C. 154(b) by 0 days.

(21) Appl. No.: 17/670,894

(22) Filed: Feb. 14, 2022

(51) Int. Cl.
*A24D 3/04* (2006.01)
*A24D 3/18* (2006.01)

(52) U.S. Cl.
CPC ..... *A24D 3/185* (2013.01); *A24D 3/048* (2013.01)

(58) Field of Classification Search
None
See application file for complete search history.

*Primary Examiner* — Dennis R Cordray
(74) *Attorney, Agent, or Firm* — Cohen IP Law Group, PC; Michael N. Cohen

(57) ABSTRACT

An insert system for use with a smokable (e.g., such as a pre-rolled or empty cone) including an internal partition for securing one or more flavor releasing mechanisms (e.g., flavored "click balls") within a flavor mechanism holder and for use with a smokable item (e.g., a pre-roll cone, an empty cone, a pre-rolled or hand-rolled cigarette, etc.) is provided. The insert system is formed by rolling a section of suitable material to form an elongate member with an internal volume with a longitudinal partition. The longitudinal partition forms a compartment to receive and secure a flavor releasing mechanism held within a tubular holder. The insert system may then be coupled with a smokable to serve as the smokable's mouthpiece.

14 Claims, 15 Drawing Sheets

SMOKABLE INSERT SYSTEM INCLUDING FLAVOR RELEASING MECHANISMS HELD BY AN INTERNAL PARTITION

FIELD OF THE INVENTION

The present invention relates to smokable pre-rolls, including smokable pre-rolls with embedded flavor releasing mechanisms.

BACKGROUND

Ready-to-smoke smokables come in many forms and shapes, ranging from cigarettes to pre-rolls (e.g., pre-rolled cones as shown in FIG. 1). For those who wish to form his/her own smokable, empty cones are available into which the user adds his/her own smokable materials. In either case, the smokable oftentimes includes an insert system (such as a filter or crutch) that serves as a mouthpiece at one end of the smokable.

A new phenomenon is happening within the smokables industry involving the inclusion of flavor releasing mechanisms within the smokable insert system. In many cases, the flavor releasing mechanisms include small spheres filled with a flavoring substance (also known as "click balls") that are designed to be squeezed by the user to effectively explode and release the flavoring. However, it is oftentimes costly and labor intensive to place and secure the flavor releasing mechanism properly within the insert during the manufacturing process.

Accordingly, there is a need for an insert system that includes an easy to use system and method to incorporate one or more flavor releasing mechanisms into a smokable insert to maximize the user's smoking experience.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

For the purposes of this specification, the terms below will mean the following.

Cigarette generally refers to a smokable comprising a thin cylinder of finely cut tobacco, cannabis, other types of leaves, flowers, herbs, and/or other smokable materials, rolled in a suitable paper for smoking.

Figure 1:
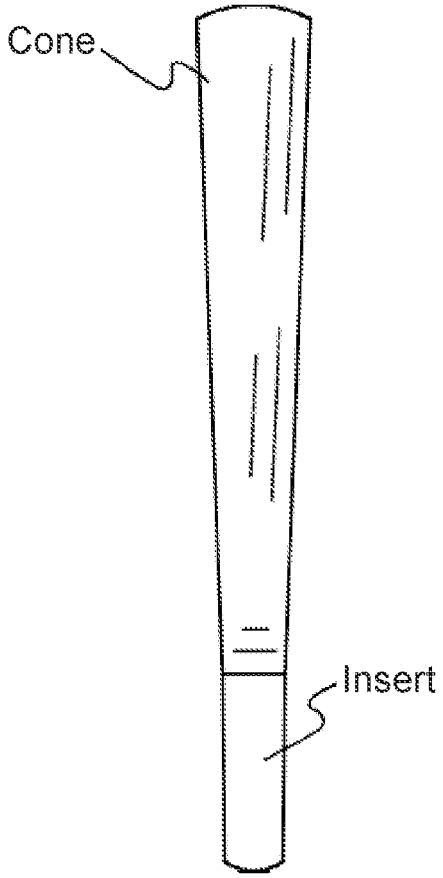
FIG. 1 (Prior Art)
FIG. 1 shows aspects of a smokable cone (prior art)

Cone generally refers to a conical- or frustum-shaped cigarette (or "joint") wherein the shape flares from a smaller diameter proximal base to a larger diameter distal tip (see FIG. 1). Cones may typically comprise paper, hemp, palm leaves, rice, cotton cellulose, glycerin, and/or other suitable materials.

Pre-roll generally refers to a cigarette or cone that has been formed prior to its sale and is therefore consumer-ready (i.e., a consumer is not required to fill or otherwise form the smokable).

Empty cone refers to an empty cone into which a consumer may place smokable materials (e.g., tobacco, cannabis, etc.) to form a smokable cone.

Insert system generally refers to a mouthpiece or tip coupled with a cone or cigarette (see FIG. 1) that acts to support the proximal end of the smokable (e.g., the end that is pressed against one's lips for smoking). An insert system may include a "crutch" formed of thick paper, glass or other materials, a filter (e.g., a cotton filter), other types of insert systems, and any combinations thereof. Insert systems may be used with cigarettes, cones (pre-rolled, empty, etc.), rolling papers, and other types of smokable items.

In general, and according to exemplary embodiments hereof, an insert system 10 including an internal partition for securing flavor releasing mechanisms (e.g., flavored "click balls") within a flavor mechanism holder and for use with a smokable item (e.g., a pre-roll cone, an empty cone, a pre-rolled or hand-rolled cigarette, etc.) is provided. In some embodiments, the insert system 10 with an internal partition and flavor releasing mechanism is provided as a standalone item for use in pre-rolling and/or hand rolling a cone, cigarette, etc. In this case, flavor releasing mechanisms may be inserted into the insert system's internal compartment and the insert system 10 may be coupled with the proximal end of a rolling paper or cone to form the smokable item. In other embodiments, the insert system 10 includes (e.g., is coupled with) an empty cone and is provided to the consumer. In this case, it may be preferable that the insert system 10 include flavor releasing mechanisms already placed within the insert system's internal compartment and ready for use by the consumer. The consumer then may fill the empty cone with smokable materials to form a smokable cone wherein the insert system 10 is used as the cone's mouthpiece. It is understood that the insert system 10 may be used with any suitable smokable item in any suitable configuration and that the examples provided herein are not meant to be limiting.

Figure 2:
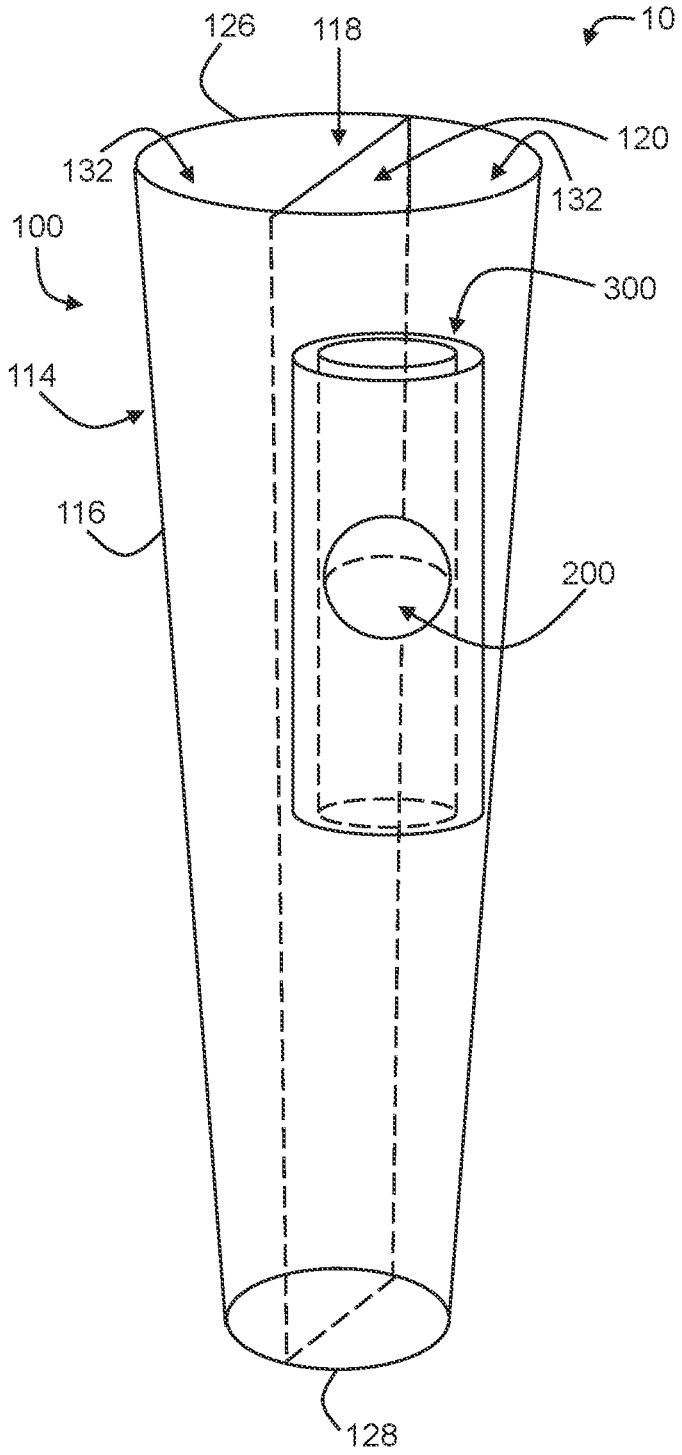
FIG. 2 shows aspects of an insert system according to exemplary embodiments hereof.

In one exemplary embodiment hereof as shown in FIG. 2, the insert system 10 includes a section 100 and one or more flavor releasing mechanisms 200 held within a flavor mechanism holder 300. As described herein, the section 100 is formed into an insert body 114 and the flavor releasing mechanism 200 within the flavor mechanism holder 300 is placed inside the insert body 102 to form the insert system 10. The insert system 10 also may include other elements as necessary for the system 10 to perform its functionalities.

Section 100

Figure 3:
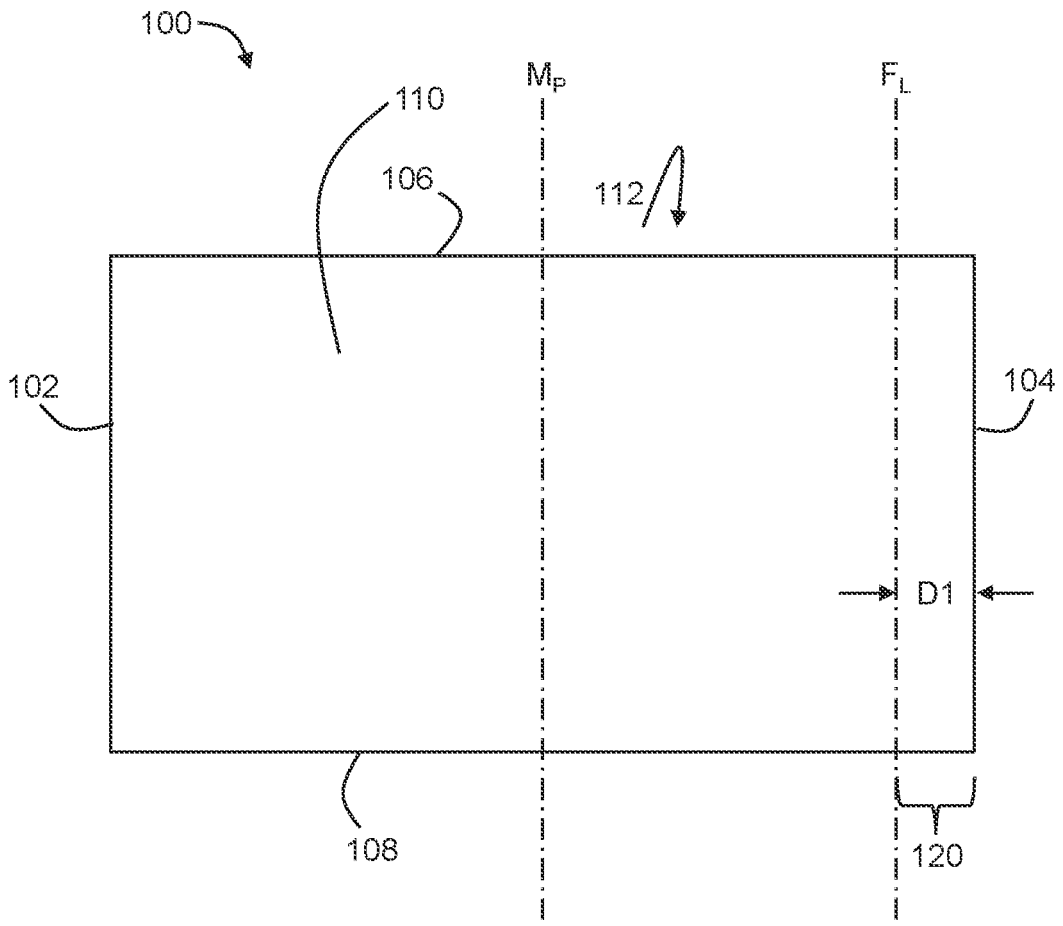
FIGS. 3-4 show aspects of a section for forming an insert system according to exemplary embodiments hereof.
Figure 4:
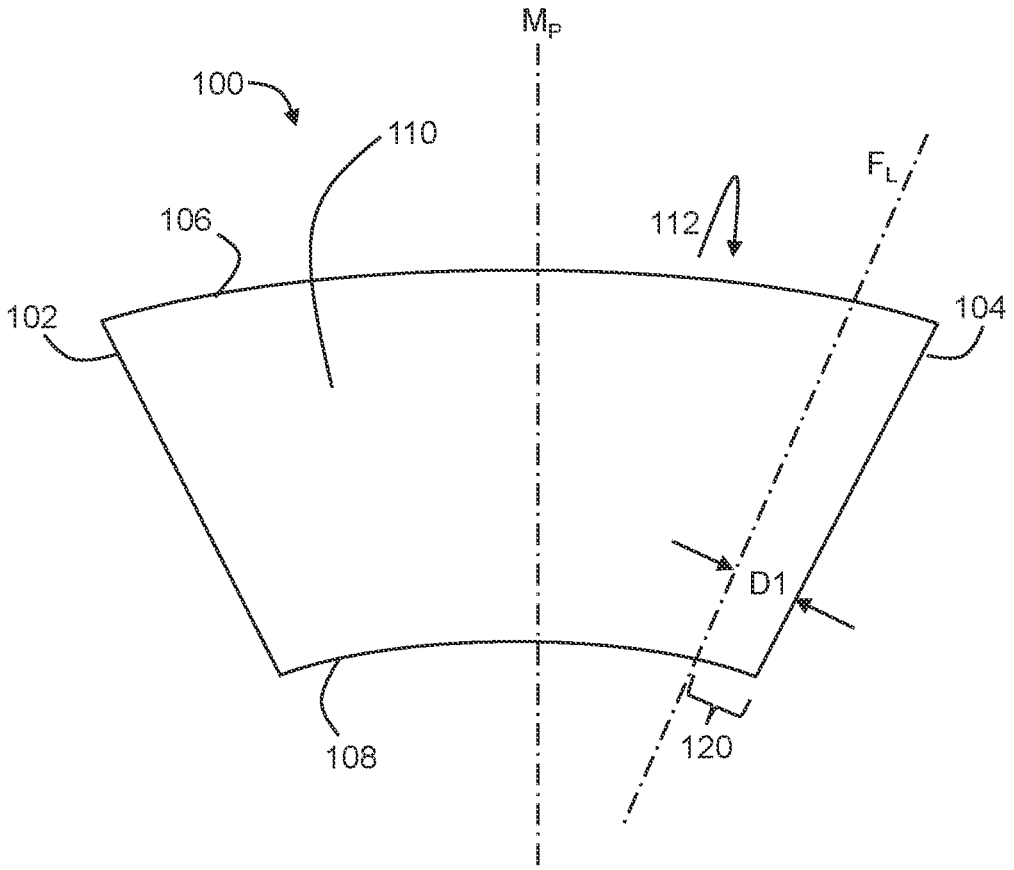

As shown in FIGS. 3 and 4, the section 100 includes a left side 102, a right side 104, a top side 106, a bottom side 108, a front 110, and a back 112. As described in other sections, the section 100 may be rolled upon itself to form an insert body 114 comprising an elongate member with sidewalls 116 defining an inner volume 118 (see FIG. 2) adapted to receive, contain, and secure one or more flavor releasing mechanisms 200 within a flavor mechanism holder 300.

The section 100 may comprise a flat piece of paper, cardboard, plastic, silicon, rubber, leaves, composite material(s), any other suitable material(s), and any combinations thereof. The section 100 is preferably a thin type of suitable material that is preferably non-toxic, flavorless, and burnable without adding any residual flavor to the smokable. In addition, the section 100 also is preferably porous so that it may disperse the flavoring released by the one or more flavor releasing mechanisms 200 evenly (however, this may not be necessary).

In some embodiments as shown in FIG. 3, the section 100 is generally rectangular in shape and may be used to form a generally cylindrical or tubular insert system 10. In other embodiments as shown in FIG. 4, the section 100 is shaped as an opened frustrum wherein the shape includes a leftward slanting left side 102, and a rightward slanting right side 104, a convex top side 106, and a concave bottom side 110. In this embodiment, the section 100 is used to form a generally frustum-shaped insert system 10 (e.g., a cone). It is understood that the shapes described above are meant for demonstration and that the section 100 may be formed as any suitable shape (e.g., trapezoidal, etc.).

Figure 15:
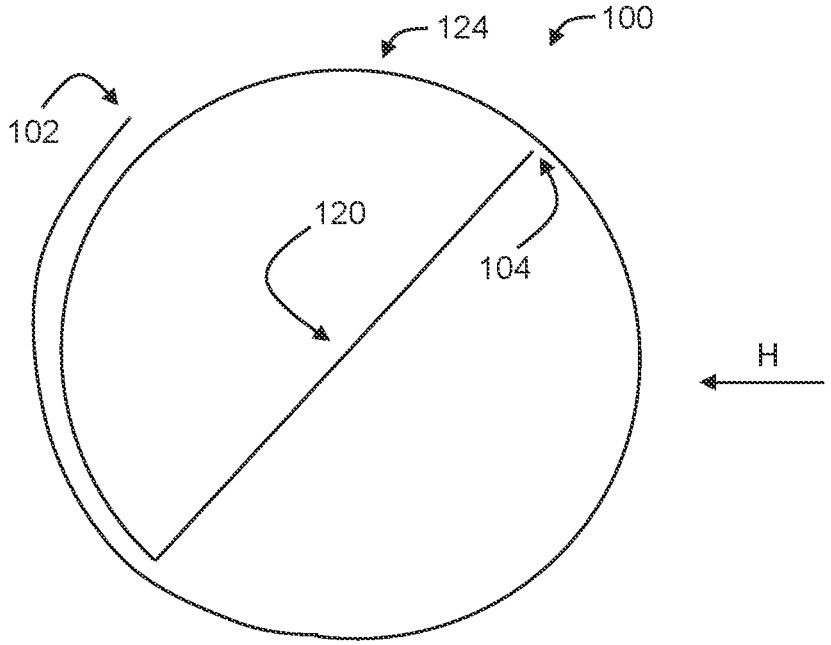

In some embodiments as shown in FIGS. 3 and 4, the section 100 includes a midpoint $M_P$ located midway between the left side 102 and the right side 104. The section 100 also includes a folding portion 120 comprising a portion with width $D_1$ generally aligned along the section's right side 104 (or left side). As will be described in other sections, the folding portion 120 may be folded along a fold line represented by the line $F_L$ to form an inner partition 122 within the insert body 114 (see FIG. 2). As will be described in other sections, in some embodiments, the width $D_1$ of the folding portion 120 is chosen to be about equal to a desired diameter of the resulting insert system 10 (as shown in FIG. 15).

Flavor Releasing Mechanisms 200

Figure 5:
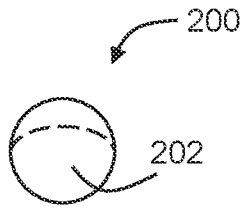
FIG. 5 shows aspects of a flavor releasing mechanism according to exemplary embodiments hereof.

In some embodiments as shown in FIG. 5, the flavor releasing mechanisms 200 include any type of solid, liquid, or gas (and any combinations thereof) that may release one or more flavors when activated. The mechanisms 200 may be designed to be activated by heat (e.g., during smoking), by pressure (e.g., may be squeezed, pricked, or otherwise exploded, etc.), by other activation techniques, and by any combinations thereof.

In some embodiments as shown in FIG. 5, the flavor releasing mechanisms 200 include one or more flavor balls 202 (also referred to as click balls) comprising a crushable spherical container with a flavoring substance inside. The click balls 202 may be adapted to generally burst (or otherwise open) when squeezed thereby releasing the flavoring substance. In this way, a user may squeeze a click ball 202 embedded within the insert system 10 when a flavoring is desired during the smoking experience. While the flavor balls 202 described herein are described primarily as spherical shaped, it is understood that the flavor balls 202 may be formed as an ovoid, a cuboid, a cylinder, pill-shaped, as any other suitable shape, and as any combinations thereof. It also is understood that the cutout 114 is preferably formed to generally match or at least accommodate the shape of the flavor releasing mechanism 200 as described herein.

It is understood that any other type(s) and/or shapes of flavor releasing mechanisms 200 may be used with the insert system 10, and that the scope of the insert system 10 is not limited in any way by the type of flavor releasing mechanism (s) 200 used.

Flavor Mechanism Holder 300

Figure 6:
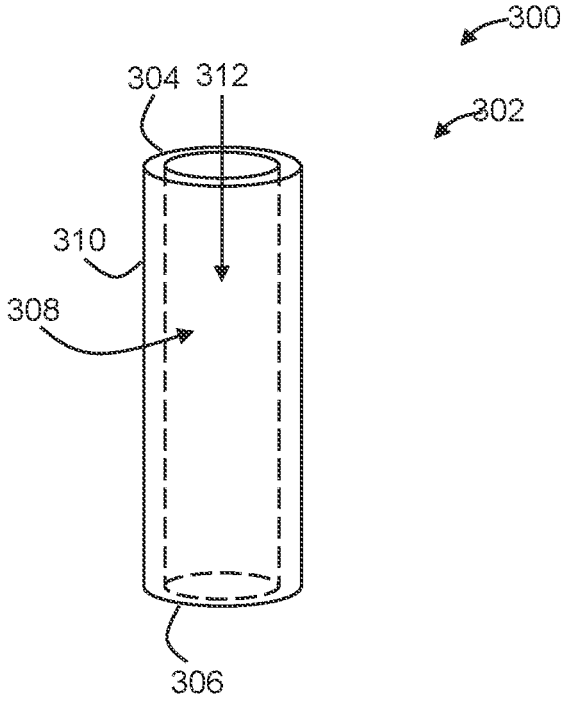
FIG. 6 shows aspects of a flavor releasing mechanism holder according to exemplary embodiments hereof.
Figure 7:
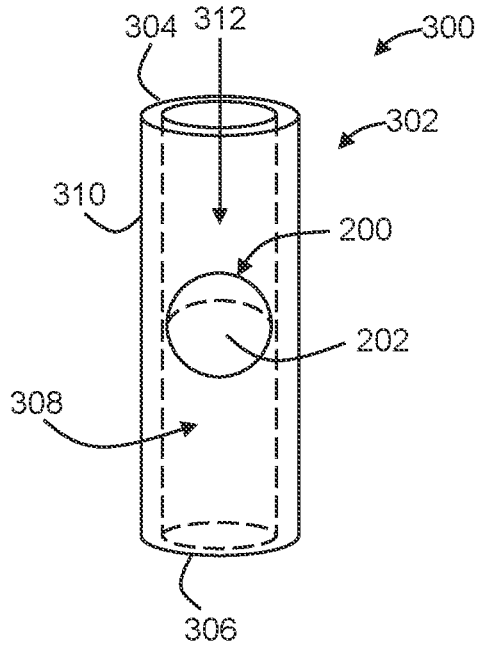
FIGS. 7-8 show aspects of a flavor releasing mechanism within a holder according to exemplary embodiments hereof.

In some embodiments, as shown in FIGS. 6 and 7, the flavor mechanism holder 300 (also referred to as simply the holder 300) includes a holder element 302 adapted to receive and generally surround and hold the flavor releasing mechanism 200.

In some embodiments, as shown in FIGS. 2-4, the holder element 302 includes a generally tubular structure (an elongate member) including a first end 304, a second end 306 and a holder body 308 with sidewalls 310 extending from the first end 304 to the second end 306. Being generally tubular, the holder body 308 includes a hollow inner passageway 312 extending between the first end 304 to the second end 306. In some embodiments, the holder body 308 and the inner passageway 312 include generally circular cross-sections. However, it is understood that the holder body 308 may include other shapes (e.g., frustum shaped), with other shaped cross sections (e.g., oval) and any combinations thereof. It also is understood that the inner passageway 312 may include other shapes (e.g., may be frustum shaped) and that the cross section of the inner passageway 312 may be circular, rectangular, oval, polygonal, include other shapes and any combination thereof.

In some embodiments, the holder body 308 includes a slot in the sidewalls 310 extending from its first end 304 to the second end 306. This may result from the holder body 308 being formed of a section of material (e.g., a rectangular section of holder material) rolled into a tubular form during the manufacturing process.

In some embodiments, the holder body 308 comprises a compressible material. In some embodiments, the holder body 308 is compressible so that the holder body 308 may be squeezed using normal human strength to deflect the side walls 310 inward. This deflection may in turn compress a flavor mechanism 200 held within the holder body 308 so that the flavor mechanism 200 may burst or otherwise open and release flavor as described in other sections.

In some embodiments, the holder body 308 comprises a polymer. In some embodiments, the holder body 308 includes silicone (e.g., preferably food grade silicone). In other embodiments, the holder body 308 comprises rubber, plastic, other types of polymers, paper, cotton, a gelatinous substance (e.g., gelatin or other gelatinous substances), foam, webbing, plant material(s) (e.g., leaf material), wood, other compressible materials, and any combinations thereof.

In some embodiments, the holder body 308 may be solid, porous, and any combinations thereof.

Figure 8:
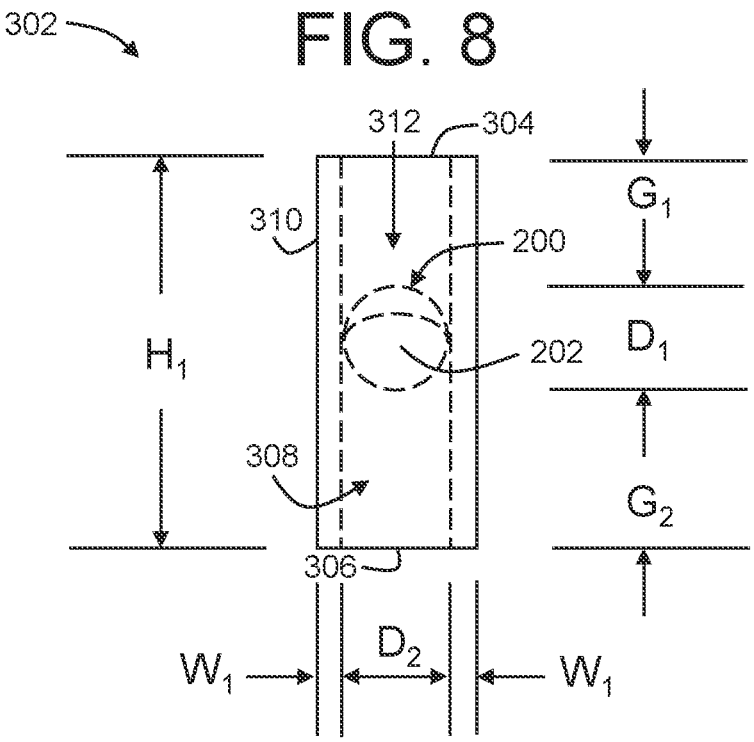

In some embodiments, as shown in FIGS. 7 and 8, the holder body 308 is designed to receive and secure a flavor mechanism 200 within its structure, e.g., within its hollow inner passageway 312. FIG. 7 shows a schematic of the holder 300 including a flavor mechanism 200 and FIG. 8 shows a side view of the same. In some embodiments, the width or diameter $D_2$ of the inner passageway 310 preferably matches the width or diameter $D_1$ of the flavor mechanism 200. In this way, the flavor mechanism 200 may be held within the holder body 308 (within the inner passageway 312) by friction between the flavor mechanism 200 and the inner side walls of the inner passageway 312.

In some embodiments, the width or diameter $D_2$ of the inner passageway 312 may be chosen to be slightly less than the width or diameter $D_1$ of the flavor mechanism 200. In this way, the inner passageway 312 may expand upon receiving the flavor mechanism 200 (the holder body 308 comprising a compressible material) to accommodate the mechanism's 200's slightly wider width $D_1$. Given this, the flavor mechanism 200 may be held within the holder body 308 (within the inner passageway 312) by friction between the flavor mechanism 200 and the inner side walls of the inner passageway 312, the friction being increased by the compressive force applied to the flavor mechanism 200 by the expanded inner passageway 312.

In some embodiments, as shown in FIG. 8, the flavor mechanism 200 is located within the inner passageway 312 between the first end 304 and the second end 306, and preferably about midway between the first end 304 and the second end 306. In some embodiments, the height $H_1$ of the holder 300 is greater than the diameter $D_1$ of the flavor mechanism 200 so that a first gap $G_1$ exists between the first end 304 and the flavor mechanism 200, and a second gap $G_2$ exists between the second end 306 and the flavor mechanism 200. In this way, no elements of the insert system 10 come into physical contact with the flavor releasing mechanism 200 except for the flavor mechanism holder 300 (due to the gaps $G_1$, $G_2$ separating the flavor mechanism 200 from any elements outside the holder 300). In other words, the flavor mechanism 200 fits entirely within the inner passageway 310.

In some embodiments, as shown in FIG. 8, the overall diameter of the holder body 308 is equal to the diameter $D_2$ of the inner passageway 310 plus twice the width $W_1$ of the holder body's side walls 310. As will be described in other sections, it may be preferable that the diameter of the holder body 308 be less than the diameter of the insert body 114 so that the holder body 308 may fit within the inner volume 118 of the insert body. In other embodiments, it may be preferable that the diameter of the holder body 308 be about 10%-90% the diameter of the insert body 114, and more preferably about 20%-80% the diameter of the insert body 114, and more preferably about 50%-70% the diameter of the insert body 114.

It is understood that more than one flavor releasing mechanism 200 may be placed within a flavor mechanism holder 300 with gaps $G_1$, $G_2$ existing between the flavor releasing mechanisms 200 and the ends 304, 306 of the holder 300. In this way, an insert system 10 including two or more flavor releasing mechanisms 200 may be formed.

Forming and Using the Insert System 10

For the purposes of this specification, the forming of the insert system 10 using the section 100 and the flavor releasing mechanism 200 within a flavor mechanism holder 300 will be described primarily with respect to the section 100 embodiment of FIG. 4. However, it is understood that the methodology described herein also may be applied to any other embodiment(s) of the section 100 described herein or otherwise.

Figure 9:
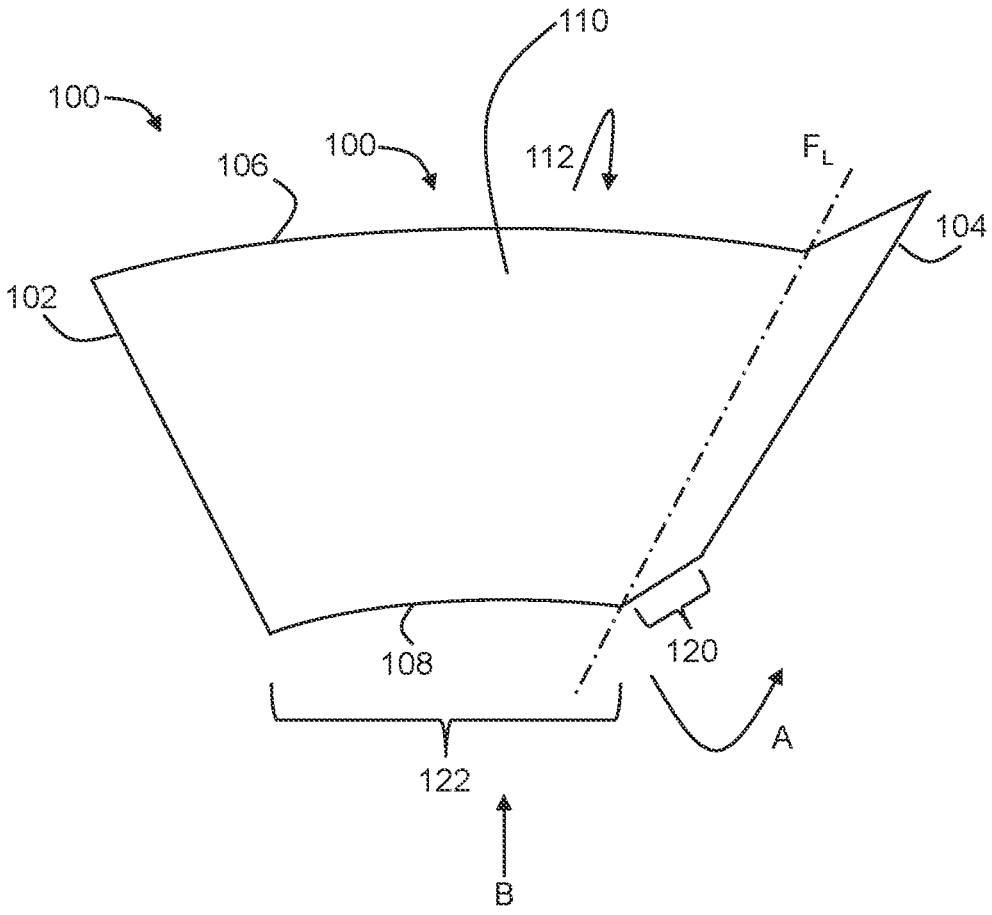
FIGS. 9-15 show aspects of a foldable section for forming an insert system according to exemplary embodiments hereof.

First, as shown in FIG. 9, with the section 100 generally flat, the folding portion 120 is folded upward at the fold line $F_L$ in the direction of the arrow A such that the portion 120 extends upward as shown. In some embodiments, the folding portion 120 may extend upward at an angle of about 45° with respect to the unfolded portion 122 of the section 100, but it is understood that the folding portion 120 may be folded at any suitable angle in order for the section 100 to perform its functionalities.

Figure 10:
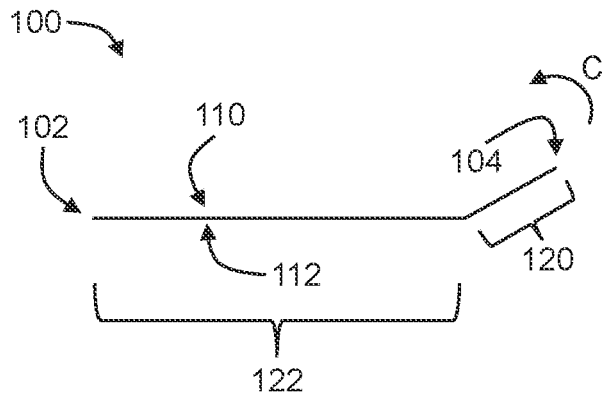

FIG. 10 shows the section 100 of FIG. 9 after the initial folding of the folding portion 120 and taken from the perspective of the arrow B in FIG. 9.

Figure 11:
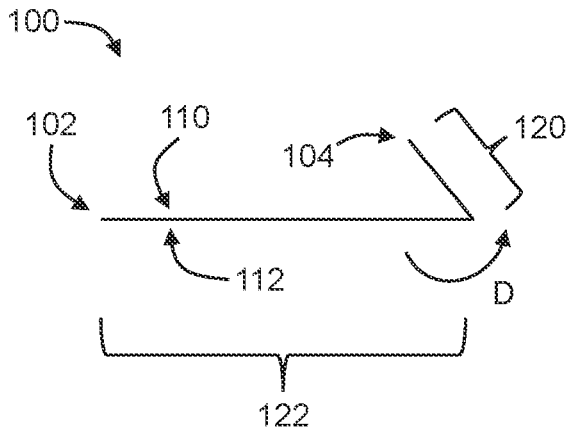

Next, as shown in FIG. 10, the folding portion 120 is folded in the direction of the arrow C resulting in the configuration shown in FIG. 11 with the folding portion 120 folded to about 135° as shown.

Figure 12:
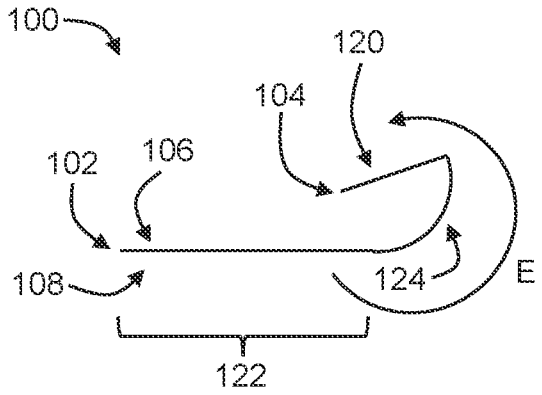

Next, as shown in FIG. 11, a portion of the unfolded portion 122 towards the right side of the unfolded portion 122 is curved upward in the direction of the arrow D to form an arc segment 124 (e.g., a segment of a semicircle) as shown in FIG. 12. This reduces the length of the unfolded portion 122 by the amount of the section 100 used to form the arc segment 124. Also, it is preferred that the folding section 120 remain a straight section as shown and that only the arc segment 124 is formed into the curve.

Figure 13:
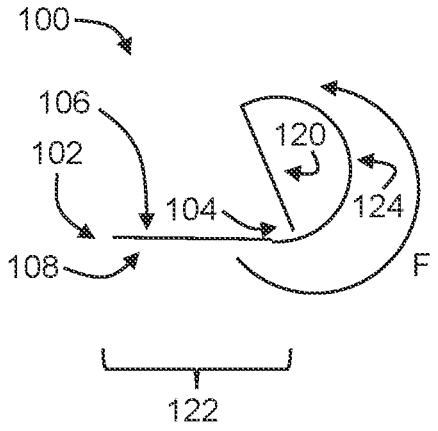

Next, the arc segment 124 is increased in size by bending the portion of the unfolded portion 122 to the immediate left of the arc segment 124 upward in the direction of the arrow E. This results in an increased size arc segment 124 (e.g., the arc segment 124 may be formed into a semicircle) and a decreased size unfolded portion 122 as shown in FIG. 13.

Figure 14:
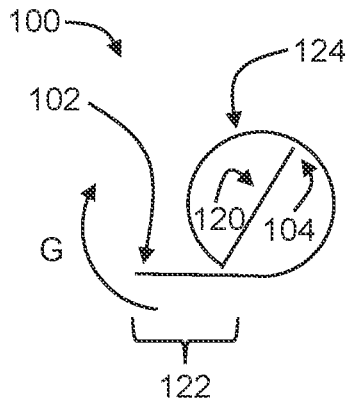

As shown, at this point, the arc segment 124 may generally form a semicircle (e.g., a half disc) with the folding portion 120 extending across its base diameter. Next, a portion of the unfolded portion 122 to the immediate left of the arc segment 124 is curved upward in the direction of the arrow F in FIG. 13 to form the arc segment 124 into a full circle as shown in FIG. 14. Notably, it is preferable that the folding portion 120 generally bisect the full circle arc segment 124 as shown.

Figure 17:
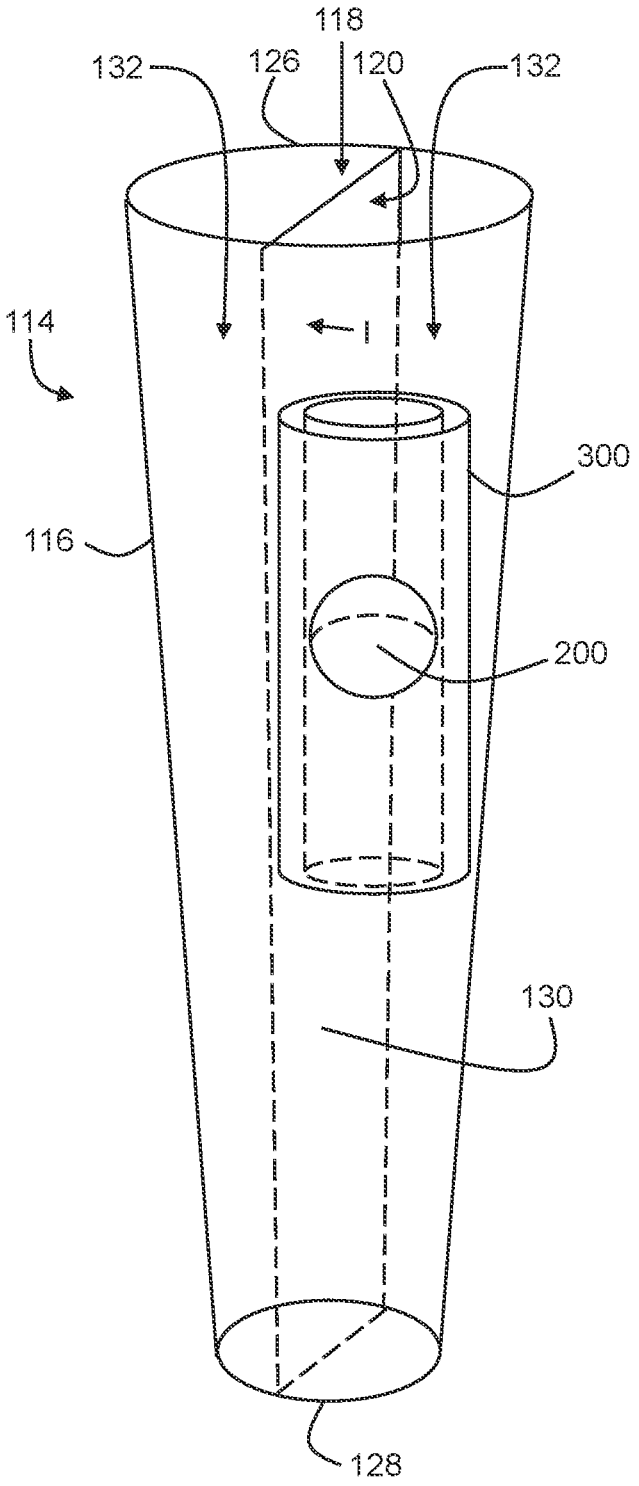
FIGS. 17-19 show aspects of an insert system according to exemplary embodiments hereof.

Next, the remaining unfolded portion 122 is folded around the full circle arc segment 124 to overlap the arc segment 124 and to effectively form the insert body 114 comprising an elongate member with sidewalls 116 defining an inner volume 118 as shown in FIG. 17. Given the above, it may be preferable that the length of the unfolded portion 122 of FIG. 11 be sufficient to encircle the folding portion 120 at least once so a full circle arc segment 124 with overlap as shown in FIG. 15 may be formed.

Figure 16:
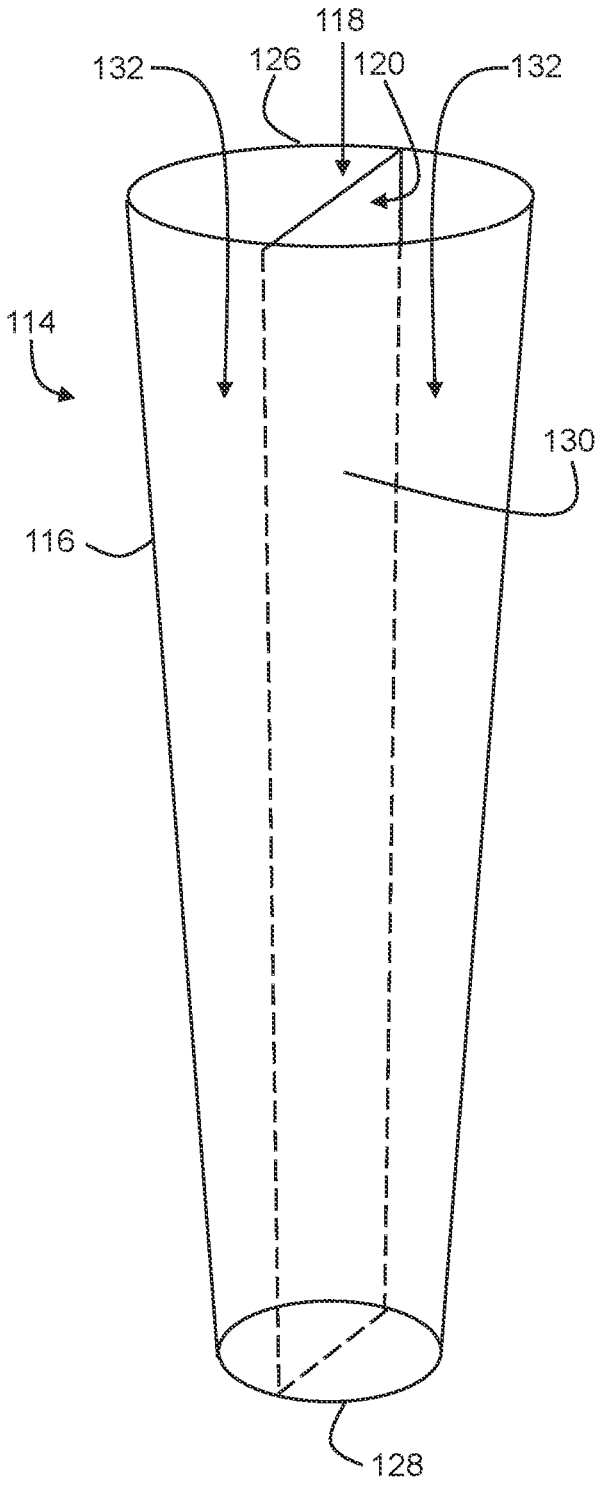
FIG. 16 shows aspects of an insert body according to exemplary embodiments hereof.

FIG. 17 shows the insert body 114 taken from the perspective of the arrow H in FIG. 16. The top end 126 of the insert body 114 generally comprises the curved and/or folded top side 106 of the section 100, and the bottom end 128 of the insert body 114 generally comprises the curved and/or folded bottom side 108 of the section 100.

In some embodiments as shown in FIG. 16, the folding portion 120 forms a partition 130 within the inner volume 118 generally extending from the top end 126 to the bottom end 128. The partition 130 generally extends across the inner volume 118 from opposing locations along the inner surface of the sidewalls 116. In some embodiments, it may be preferable that the partition 130 bisect the cross-section of the inner volume 118, but as explained in other sections, this may not be required.

In some embodiments, as shown in FIG. 16, the partition 130 forms two adjacent longitudinal compartments 132 within the inner volume 118, with each compartment preferably extending from the insert body's top end 126 to its bottom end 128.

In some embodiments, as shown in FIG. 17, a flavor releasing mechanism 200 is placed within a flavor mechanism holder 300 as described herein, and the combination flavor releasing mechanism 200 and holder 300 is placed within the inner volume 118 of the insert body 114 to form the insert system 10. In some embodiments, the combination flavor releasing mechanism 200 and holder 300 is placed within a compartment 132 (e.g., into the right compartment 132 as shown and/or into the left compartment 132) and held therein by friction and pressure between the partition 130 and an inner surface of a sidewall 116.

Figure 18:
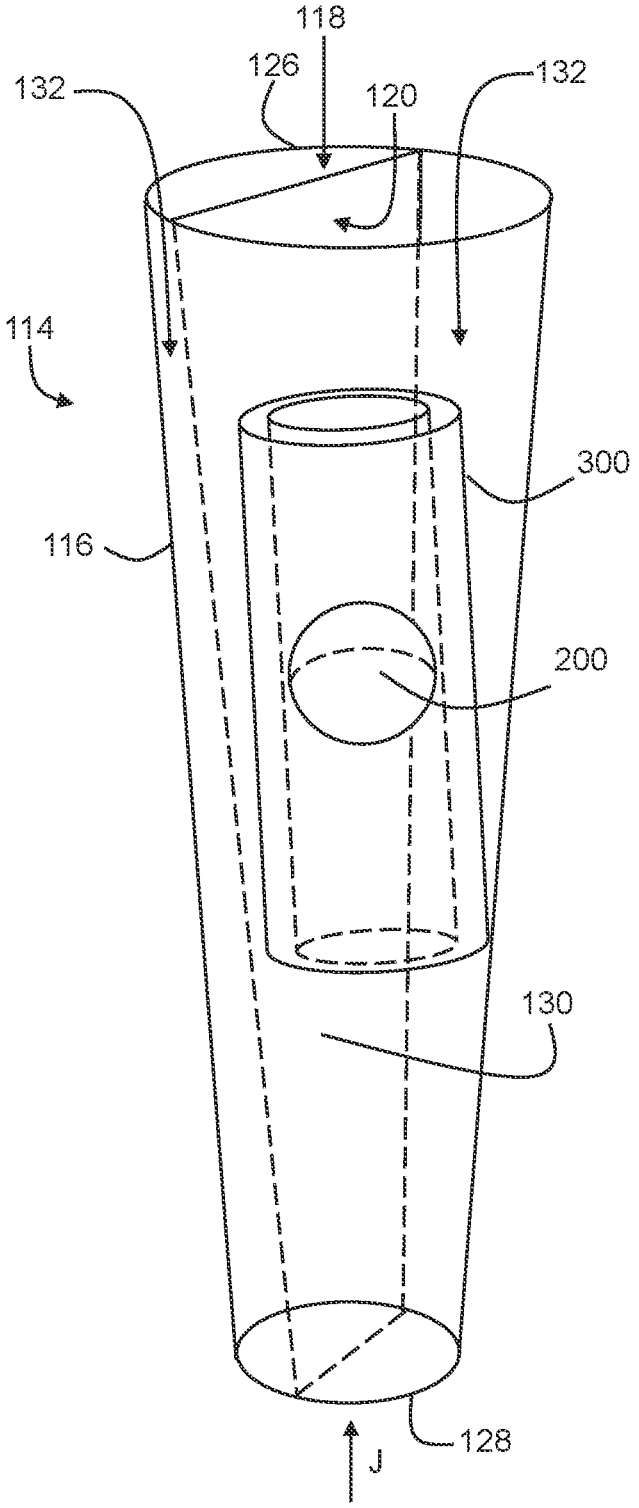

In some embodiments, the flavor mechanism 200 and holder 300, when placed within a compartment 132 may exert a sideways force onto the partition 130 as represented by the arrow I in FIG. 17. This may result in a portion of the partition 130 translating to the side as shown in FIG. 18. In some embodiments, it may be preferable that as the partition 130 translates to the side that the portion of the partition 130 towards the bottom end 128 of the insert body 114 remain somewhat centered. However, it is understood that the partition 130 towards the bottom end 128 also may translate to the side.

Figure 19:
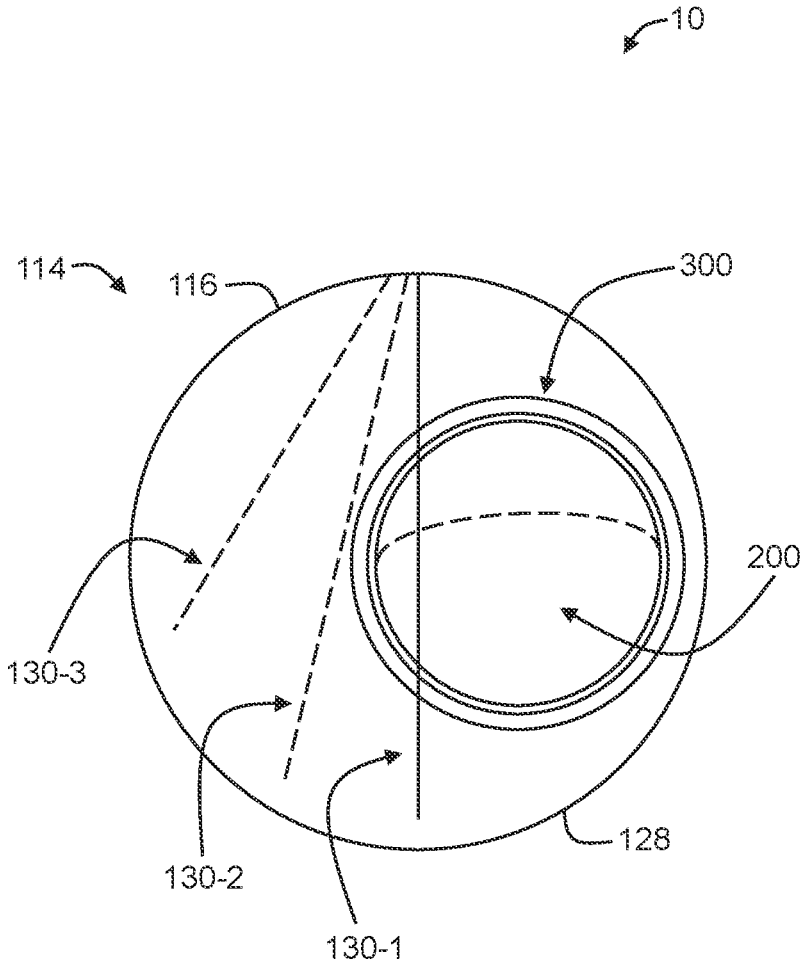

For example, FIG. 19 shows the insert body 114 of FIG. 18 from the perspective of the arrow J in FIG. 18. As shown, the partition 130-1 represents the portion of the partition 130 at the bottom end 128 of the insert body 114 generally bisecting the circular cross-section of the bottom end 128, while partitions 130-2 and 130-3 show the partition 130 moved to the side by the flavor releasing mechanism 200 and holder 300 combination. In general, it may be preferable that the partition 130 extend across at least a portion of the cross-section of the bottom end 128 of the insert body 114 so that a person looking into the bottom end 128 may see at least a portion of the partition 130 in this position. This may provide a feeling to the user that the flavor mechanism 200 within the holder 300 within the insert body 114 is secured in such a way that it will not extend out the bottom end 128 when used (e.g., smoked).

It is understood that the actions described above to form an insert system 10 using a section 100, a flavor releasing mechanism 20, and a flavor mechanism holder 300 are meant for demonstration and that the method of forming the insert system 10 may include other actions not necessarily described, may not include all of the actions described, and/or any combinations thereof. In addition, the actions may be performed in a different order.

Figure 20:
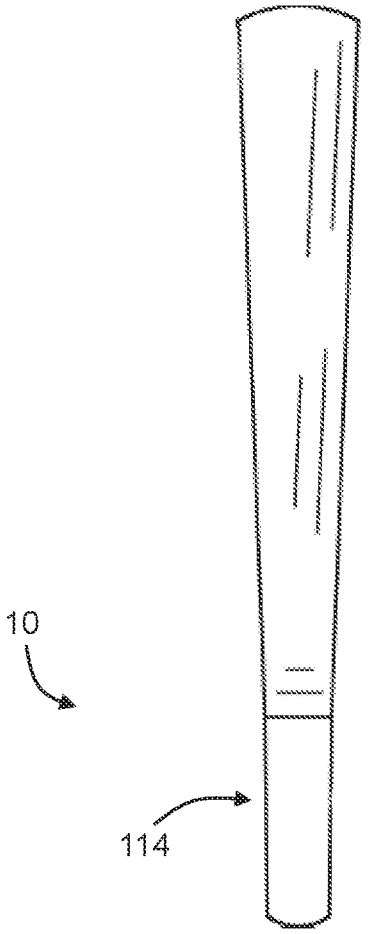
FIG. 20 shows aspects of an insert system configured with a smokable item according to exemplary embodiments hereof.

In some embodiments as shown in FIG. 20, once the insert system 10 has been formed as described above or otherwise, it may be used as a tip, a mouthpiece, a crutch, a filter, as any type of base for a pre-roll, cone, empty cone, cigarette, other type of smokable, and for any combinations thereof as known in the art or otherwise. For example, in some embodiments, the insert system 10 may be provided to manufacturers of pre-roll cones and/or cigarettes, of empty cones, etc. to be coupled to these types of products and then sold to consumers. In another example, the insert system 10 may be coupled with a pre-roll cone and/or cigarette, and/or to an empty cone during its manufacturing and made for sale to consumers as the combination. In another example, the insert system 10 may be sold directly to consumers such that the consumers themselves may couple the insert system 10 with a rolling paper to form a cigarette, a cone, an empty cone, or other type of smokable item. It is understood that the examples described above are meant for demonstration and are non-limiting.

It is understood that any details and/or aspects of any embodiments described herein may be combined with any details and/or aspects of any other embodiments in any way to form additional embodiment(s) all of which are within the scope of the filter system 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

The invention claimed is:

1. An insert system for use as a mouthpiece to a smokable item and for securing at least one flavor releasing mechanism, the insert system comprising:

a rolled section of material forming a first elongate member with a first open end and a second open end opposite the first open end defining a first inner volume extending therebetween;

a partition formed from a portion of the rolled section of material folded to traverse the first inner volume between the first open end to the second open end and to separate the first inner volume into at least two elongate compartments;

a flavor releasing mechanism holder comprising a second elongate member including a second inner volume;

a flavor releasing mechanism within the second inner volume;

wherein the flavor releasing mechanism holder is located within a first of the at least two elongate compartments.

2. The insert system of claim 1 wherein the first of the at least two elongate compartments extends from the first open end to the second open end.

3. The insert system of claim 1 wherein the flavor releasing mechanism holder comprises a tube.

4. The insert system of claim 1 wherein the flavor releasing mechanism comprises a sphere filled with flavor material.

5. The insert system of claim 1 wherein the flavor releasing mechanism is held within the flavor releasing mechanism holder by friction.

6. The insert system of claim 1 wherein the flavor releasing mechanism holder is held within the first of the at least two elongate compartments at least partially by friction between the flavor releasing mechanism holder and the partition.

7. The insert system of claim 1 wherein the second elongate member includes a third open end and a fourth open end each in communication with the second inner volume.

8. The insert system of claim 7 wherein the flavor releasing mechanism is separated from the third open end by a first distance and from the fourth open end by a second distance.

9. The insert system of claim 8 wherein the flavor releasing mechanism includes a first diameter and the first distance and/or the second distance is at least 50% of the first diameter.

10. The insert system of claim 9 wherein the first distance and/or the second distance is at least 100% of the first diameter.

11. The insert system of claim 1 wherein the flavor releasing mechanism is located entirely within the second inner volume.

12. The insert system of claim 1 wherein the second elongate member comprises silicone.

13. The insert system of claim 1 wherein the first elongate member includes a first length, and the second elongate member includes a second length, and the second length is about 30% to 80% the first length.

14. The insert system of claim 1 wherein the rolled section of material comprises at least one of paper, cardboard, and plastic.

* * * * *